US006427344B1

(12) United States Patent
Smith et al.

(10) Patent No.: US 6,427,344 B1
(45) Date of Patent: Aug. 6, 2002

(54) DRAWING COMPASS

(75) Inventors: Philip Forrest Smith, West Bridgford; Miles Wills, Bingham, both of (GB)

(73) Assignee: Novara Group Limited (GB)

( * ) Notice: Subject to any disclaimer, the term of this patent is extended or adjusted under 35 U.S.C. 154(b) by 0 days.

(21) Appl. No.: 09/366,479

(22) Filed: Aug. 3, 1999

(30) Foreign Application Priority Data

Nov. 24, 1998 (GB) ..... 9825595

(51) Int. Cl.[7] ..... B43L 9/04; B43L 13/00

(52) U.S. Cl. ..... 33/27.032; 33/32.3; 33/483

(58) Field of Search ..... 33/27.01, 27.02, 33/27.03, 27.031, 27.032, 27.033, 41.1, 41.4, 41.6, 42, 44, 32.3, 488, 483, 484, 32.1, 419, 425, 464, 470, 473

(56) References Cited

U.S. PATENT DOCUMENTS

| | | | | | |
|---|---|---|---|---|---|
| 1,498,485 | A | * | 6/1924 | Schmidtke | 33/484 |
| 2,658,278 | A | * | 11/1953 | Debs | 33/473 |
| 2,736,097 | A | * | 2/1956 | Coleman | 33/107 |
| 3,163,940 | A | * | 1/1965 | Geiser | 33/107 |
| 3,293,761 | A | * | 12/1966 | Curry | 33/150 |
| 3,474,538 | A | | 10/1969 | Kirkgaard | |
| 3,513,548 | A | | 5/1970 | Itano | |
| 3,526,446 | A | * | 9/1970 | Paige et al. | |
| 3,738,009 | A | | 6/1973 | Kuwada | |
| 4,129,948 | A | | 12/1978 | Hatter et al. | |
| 4,267,638 | A | | 5/1981 | Heinz | |
| 4,314,408 | A | * | 2/1982 | Shoemaker | 33/494 |
| 4,324,050 | A | * | 4/1982 | Weir | 33/482 |
| 4,542,588 | A | | 9/1985 | Werner | |
| 4,757,616 | A | * | 7/1988 | Hills | 33/488 |
| 5,193,284 | A | | 3/1993 | Lin | 33/449 |
| 5,317,813 | A | * | 6/1994 | Reed | 33/809 |
| 5,347,721 | A | | 9/1994 | Asterino, Jr. | 33/27.01 |
| 5,383,277 | A | * | 1/1995 | Shimoda et al. | 33/18.1 |
| 5,426,859 | A | | 6/1995 | Concari et al. | |
| 5,501,019 | A | | 3/1996 | Concari et al. | |
| 5,615,485 | A | | 4/1997 | Stoneberg | |
| 5,873,171 | A | * | 2/1999 | Hsu | 33/484 |

FOREIGN PATENT DOCUMENTS

| | | |
|---|---|---|
| GB | 1494748 | 12/1977 |
| GB | 1495139 | 12/1977 |
| GB | 1495140 | 12/1977 |

OTHER PUBLICATIONS

"Safe–T Products™, Inc., Innovative Safe Drawing and Measuring Instruments" catalog, 1998.

* cited by examiner

*Primary Examiner*—Christopher W. Fulton
(74) *Attorney, Agent, or Firm*—Thompson Hine LLP

(57) ABSTRACT

A drawing compass including a body having a pivot point and a longitudinal slot formed therein, the longitudinal slot defining a first inner surface. The drawing compass further includes a carriage received in and movable along the longitudinal slot. The carriage has a guide to receive a writing instrument therethrough and a movable arm biased against the first inner surface. The compass also includes means for releasably coupling the arm to the body.

27 Claims, 4 Drawing Sheets

DRAWING COMPASS

The present invention is directed to drawing compasses, and more particularly, to safety drawing compasses that include movable carriage.

This application claims priority to Great Britain Application No. 9825595.3.

BACKGROUND OF THE INVENTION

Compasses are widely used by both professional draftpersons and laypersons as an aid to draw arcs and circles. Most conventional compasses includes a pair of legs that are adjustably attached at a common end. One of the legs includes a tapered portion that ends in a pivot point, and the other leg is shaped to receive a writing instrument therein. In order to draw an arc, the pivot point is anchored on a paper surface, and the compass is rotated about the pivot point and while the writing instrument is passed across the surface of the paper. However, conventional compasses can be difficult to use, and the tapered portion and-pivot point may not be practical for use by children.

A "safety compass" typically includes generally flat body having a short, protruding pivot point, and the body includes a hole or a plurality of holes to receive a drawing instrument. In order to use the safety compass, the body of the compass is positioned flat against the paper to be drawn upon. A pen, pencil, or other drawing instrument is inserted into one of the holes, and the compass body and writing instrument are rotated about the pivot point such that the drawing instrument draws an arc on the paper.

The compass may also include a movable carriage that receives the writing instrument. The carriage is releasably coupled to the compass body to vary the radius of the arc to be drawn. The prior art mechanisms for releasably coupling the carriage to the compass body lack durability and robustness, and can be difficult to operate. Accordingly, there is a need for a safety compass including a carriage that can be releasably coupled to the body in a quick and easy operation, and wherein the compass is durable and robust.

SUMMARY OF THE INVENTION

The present invention is a drawing compass incorporating an improved mechanism for coupling the carriage to the body. In particular, the body and/or carriage each include a plurality of grooves and teeth for releasably coupling the carriage to the body. In one embodiment, the invention is a drawing compass comprising a body having a pivot point and a longitudinal slot formed therein, the longitudinal slot defining a first inner surface. The drawing compass includes a carriage received in and movable along the longitudinal slot. The carriage includes a guide to receive a writing instrument therethrough and a movable arm biased against the first inner surface. The compass further comprises means for releasably coupling the arm to the body.

Accordingly, it is an object of the present invention to provide a safety compass that is durable and robust, and that includes a carriage that can be quickly and easily uncoupled from the body of the compass.

Other objects and advantages of the present invention will be apparent from the following description and the accompanying drawings.

DETAILED DESCRIPTION

Figure 1:
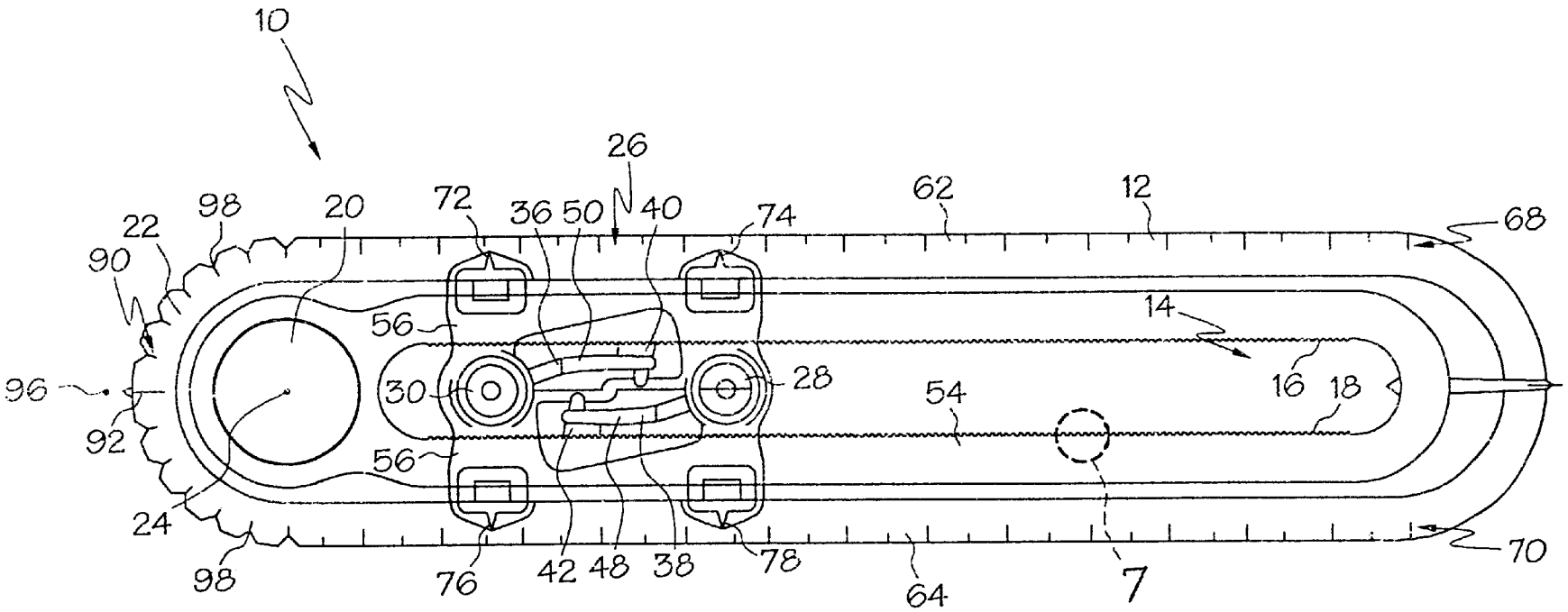
FIG. 1 is a top view of a preferred embodiment of the compass of the present invention.
Figure 8:
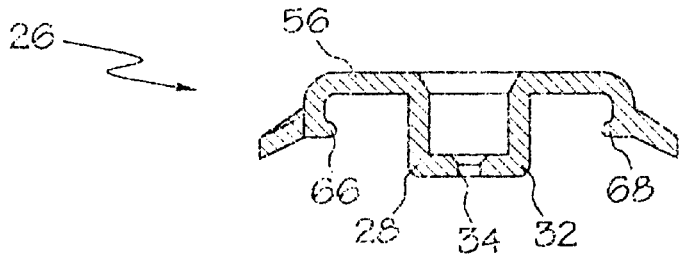
FIG. 8 is a cross sectional view taken along line 8—8 of FIG. 5.
Figure 10:
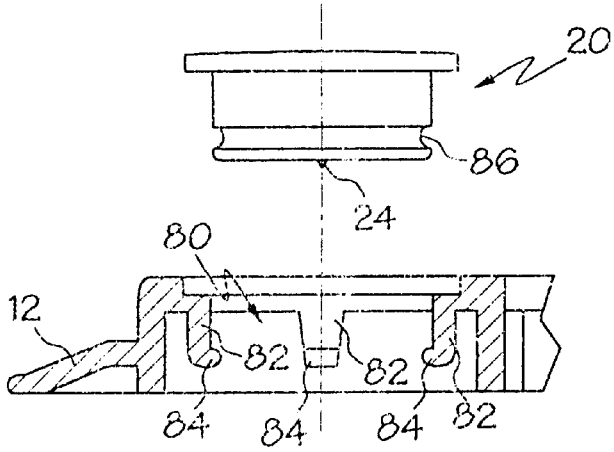
FIG. 10 is an exploded view of the lens and lens-receiving opening of the body of the compass of FIG. 1.

As shown in FIG. 1, the present invention is a drawing compass 10 including a body 12 having a longitudinally-extending slot 14. The slot 14 defines a first inner surface 16 and a second inner surface 18. The body 12 includes a generally cylindrical lens 20 adjacent to an anchor end 22 of the body 12, and the lens 20 includes a pivot point 24 extending outwardly from the surface of the lens 20 (FIG. 10). In the illustrated embodiment, the pivot point 24 is located at the tip of a small cone extending outwardly from the lens 20. The pivot point 24 is preferably integrally formed with the lens 20. Returning to FIG. 1, a carriage 26 is received in and movable along the longitudinal slot 14. The carriage 26 includes a first guide 28 and a second guide 30, each of which are shaped to receive a writing instrument therein, such as a pencil or an ink pen. As best shown in FIG. 8, the guide 28 includes a generally cylindrical portion 32 having through hole 34 at the bottom of the cylindrical portion 28. The guide 30 is substantially identical to the guide 28 shown in FIG. 8.

Figure 7:
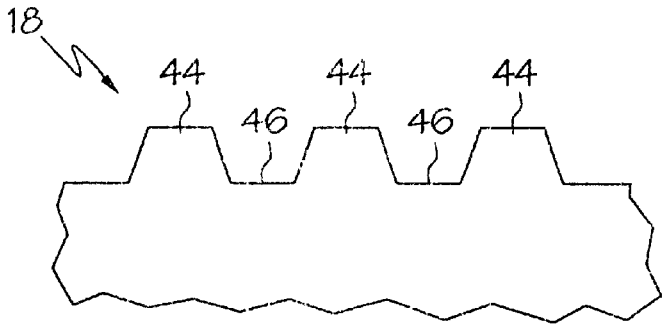
FIG. 7 is a detail view of the area indicated in FIG. 1.

Returning to FIG. 1, the carriage 26 includes a first resilient arm 36 and a second resilient arm 38. When the carriage 26 is mounted within the body 12, the arms 36, 38 are deformed inwardly from their rest positions so that they can be fit into the slot 14. In this manner, the first arm 36 is biased against the first inner surface 16 and the second arm 38 is biased against the second inner surface 18. Each arm 36, 38 includes a head 40, 42 at its distal end, and each head 40, 42 includes a grooved or toothed surface that engages the inner surfaces 16, 18. The inner surfaces 16, 18 of the body 12 also preferably include a plurality of grooves or teeth thereon. In this manner, when the head 40, 42 of each arm 36, 38 is urged into contact with the associated inner surface 16, 18, the grooves and teeth on each head 40, 42 interengage with the grooves/teeth on the inner surfaces 16, 18 to lock the carriage 26 into place relative the body 12. The grooves/teeth may take a variety of forms, and in a preferred embodiment the teeth 44 and groves 46 are generally trapezoidal in top view as shown in FIG. 7. In an alternate embodiment (not shown) the corners of the teeth 44 may be rounded to reduce wear on the teeth.

Other means beyond those specifically described herein may be used to couple the arms 36, 38 to the inner surfaces 16, 18 of the body 12, for example increasing the frictional engagement between arms 36, 38 and the body 12 by knurling or roughening, or through the use of other fasteners such as complimentary adhering materials sold under the trademark VELCRO®, or other means.

Figure 6:
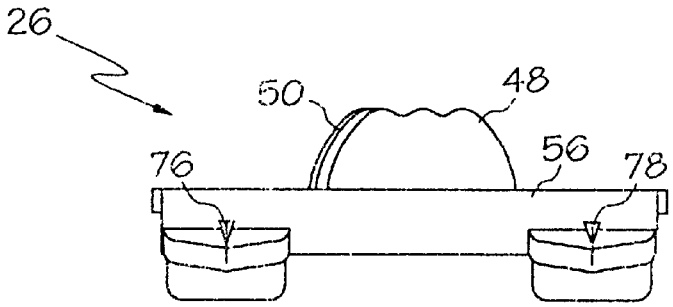
FIG. 6 is a side view of the carriage of FIG. 5.
Figure 9:
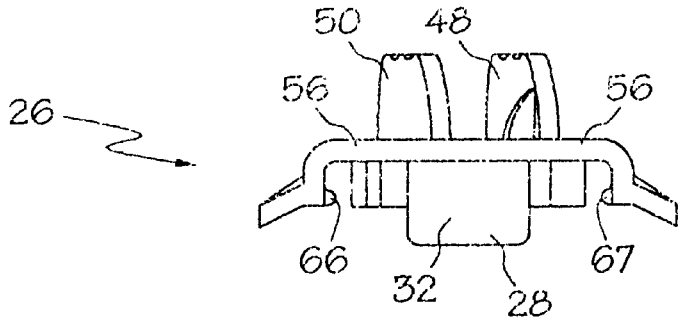
FIG. 9 is an end view of the carriage of FIG. 5.

A pair of upwardly-extending tabs 48, 50 are located on each arm 36, 38 to aid in unlocking the carriage 26 from the body 12 (FIGS. 6, 9). In order to uncouple the arms 36, 38 from the body 12, the tabs 48, 50 are displaced toward the center of the carriage 26, which pulls the arms 36, 38 away from the inner surface 16, 18. The tabs 48, 50 are arranged such that both arms 36, 38 can be simultaneously uncoupled from the body 12 in a simple manual motion. The, tabs 48, 50 are sized and located such that they can be gripped between a user's thumb and forefinger, and then squeezed together. Upon the application of sufficient pressure, each arm 36, 38 moves inwardly away from the respective inner surface 16, 18 such that each arm 36, 38 is uncoupled from the respective inner surface 16, 18 when the grooves/teeth on the carriage 26 and the grooves/teeth of the body 12 become disengaged from each other. The carriage 26 may then be moved up or down the slot 14 to the desired location while the tabs 48, 50 are continued to be squeezed by the user. Once the carriage 26 is located at the desired position, the user releases the tabs 48, 50, and the arms 36, 38 spring outwardly such that the head 40, 42 of each arm 36, 38 engages the corresponding inner surface 16, 18. The grooves/teeth on both surfaces then interlock to couple the carriage 26 to the body 12.

The arms 36, 38 are preferably made of a resilient material, to ensure the arms 36, 38 spring outwardly when the tabs 48, 50 are released. The body 12 can be made from a wide range of materials, including but not limited to acrylonitrile butadiene styrene (ABS) available under the trade names LUSTRAN, NOVODUR, and CYCLOLAC, or polymethylmethacrylate (POM-Acetal) available under the trade names DELRIN and KEMETAL. The carriage 26 can be made from a wide range of materials, including but not limited to acrylonitrile butadiene styrene (ABS) available under the trade names LUSTRAN, NOVODUR, and CYCLOLAC, or polyoxmethlylene (POM-Acetal) available under the trade name DELRIN and KEMETAL. The lens 20 can be wide from a wide range of materials, including but not limited to butadiene-styrene (SBS) available under the trade name STYROLUX and K-RESIN, or polymethylmethacrylate (PMMA-Acrylic) available under the trade name DIAKON, LUCITE and IMPLEX.

Figure 2:
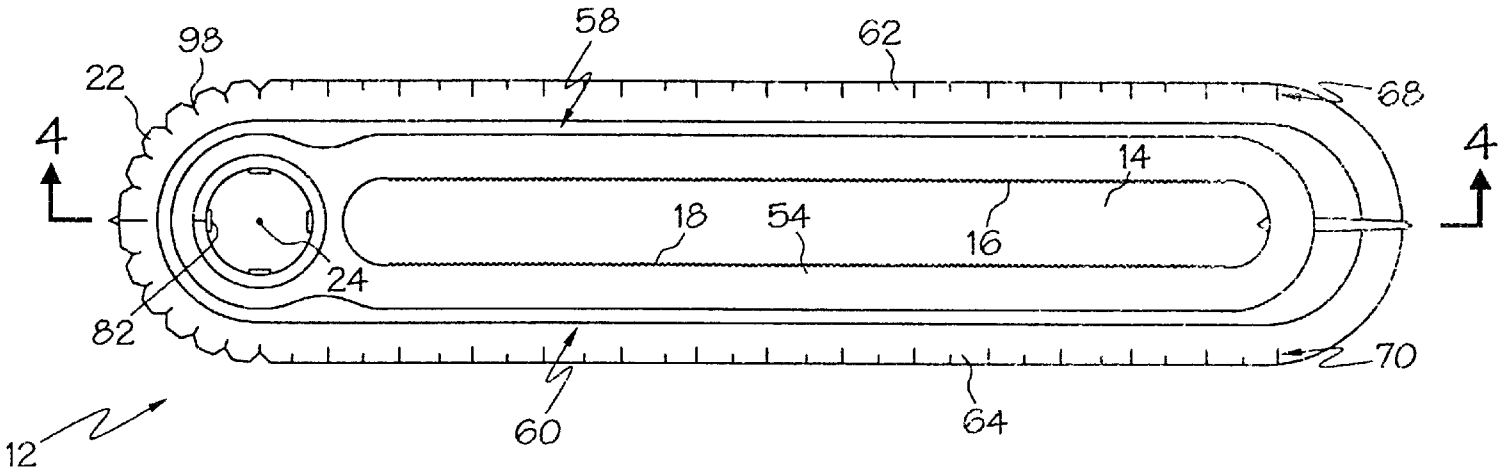
FIG. 2 is a top view of the body of the compass of FIG. 1.
Figure 3:
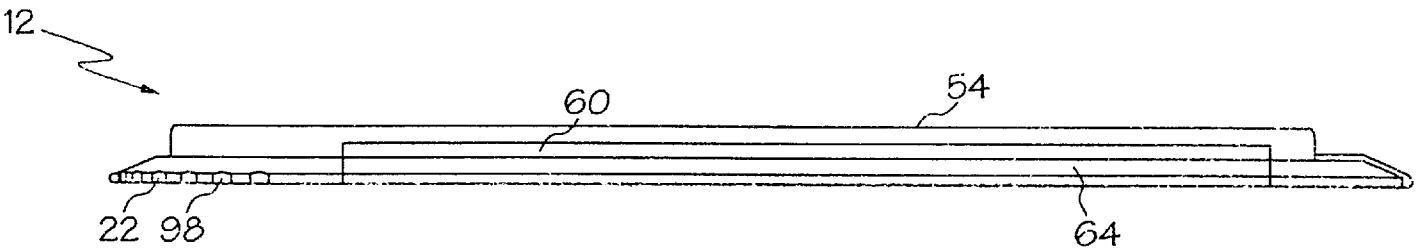
FIG. 3 is a side view of the body of FIG. 2.
Figure 4:
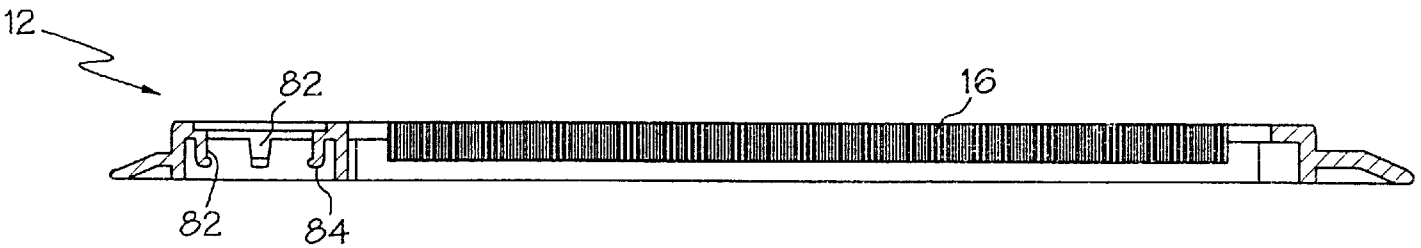
FIG. 4 is a cross sectional view taken along line 4—4 of FIG. 2.
Figure 5:
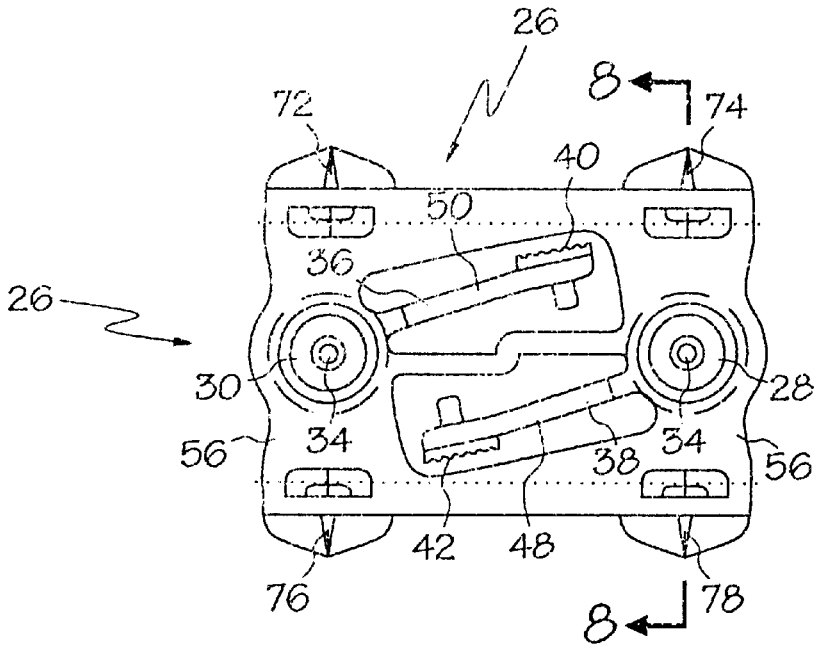
FIG. 5 is a top view of the carriage of the compass of FIG. 1.

The body 12 includes a boss 54 located about the perimeter of the slot 14, and the carriage 26 includes an overlie portion 56 shaped to fit over the boss 54. The body 12 further includes a first longitudinal side 62 and a second longitudinal side 64. As shown in FIGS. 2–3. a first guide slot 58 and is located between the boss 54 and the first longitudinal side 62, and a second guide slot 60 is located between the boss 54 and the second longitudinal side 64. As shown in FIGS. 8–9, the carriage 26 includes a set of inwardly-extending protrusions 66, 67 that are shaped to be received in the guide slots 58, 60 to couple the carriage 26 to the body 12, and to guide the carriage 26 in its translation within the body 12. The body 12 preferably includes indicia 68, 70 along the first longitudinal side 62 and the second longitudinal side 64 to indicate the distance that each guide 28, 30 is located from the pivot point 24. In this manner the radius of the arc to be drawn can be easily discerned. The overlie portion 56 of the carriage 26 includes a set of pointers 72, 74, 76, 78 that indicate the position of the guides 28, 30 relative the indicia 68, 70. The carriage 26, and particularly the portions of the carriage 26 adjacent to the pointers 72, 74, 76, 78, are preferably transparent to ensure that the pointers 72, 74, 76, 78 can be precisely located over the desired markings of the indicia 68, 70. In a preferred embodiment, the first side 62 includes a first set of indicia 68 (such as Metric units), and the second side 64 includes another set of indicia 70 (such as English units).

The longitudinal distance between the teeth on the inner surfaces 16, 18 and the arms 36, 38 is preferably small to ensure that the carriage 26 can be precisely located in the desired position. In one embodiment, each tooth 44 is spaced apart from any adjacent teeth 44 by about 1 mm. Further preferably, the teeth are formed and aligned such that the guide 26 can be located at a position that corresponds to one of the marking on the indicia 68, 70. For example, the carriage 26 may be movable in 1 mm increments such that at least one of the pointers 72, 74 of the guide 26 is always located on top of one of the millimeter markers of the metric indicia 68.

The lens 20 is preferably received in the body 12 such that the lens can rotate inside the body 12. As best shown in FIG. 10, the body 12 includes an opening 80 to receive the lens 20 therein, and a plurality of downwardly extending clips 82 are located around the perimeter of the opening 80. Each clip 82 terminates in an inwardly-extending finger 84. The lens 20 includes an annular groove 86 adjacent its lower end. The lens 20 is fit into the opening 80 such that the fingers 84 of the clips 82 are received in the groove 86, which helps to retain the lens 20 in place within the body 12 while simultaneously allowing the lens 20 to rotate relative to the body 12.

In order to utilize the compass 10, the compass 10 is laid flat onto the paper or other media to be drawn upon (not shown), and pressure is applied to the lens 20 to press the pivot point 24 into the paper. The tabs 48, 50 are then pressed inwardly to uncouple the carriage 26 from the body 12, and the carriage 26 is longitudinally moved into the desired location and the tabs 48, 50 released. The pointers 72, 74, 76, 78 and indicia 68, 70 may be used to help locate the carriage 26 to draw an arc or circle having a desired radius. A writing instrument, such as a pencil (not shown), is then passed through one of the guides 28, 30 until the tip of the pencil extends through the hole 34 and contacts the paper. The cylindrical portion 32 of the guide receives the tip of the pencil therein. Of course, the shaped of the guide 28, 30 may be varied to accommodate different sizes and shapes of writing instruments. The compass 10 and pencil are then rotated about the pivot point 24, and the pencil draws out an arc on the paper.

The anchor end 22 of the body includes rotational markings 90 thereon to indicate the angle that the compass 10 has been rotated, and thus can be used to indicate the angle of the arc that has been drawn. In order to track the degree of rotation of the compass, it may be desirable to place a zero degree mark 96 (FIG. 1) on the paper adjacent the zero degree indicia 92 before beginning to rotate the compass. The rotational indicia 90 indicates the angle that each of the indicia 90 forms with the zero degree mark 96. As the compass 10 is rotated and the arc is drawn, the relative positions between the zero degree mark 96 and the rotational indicia 90 can be used to approximate the degrees that the compass 10 has been rotated. The rounded nature of the anchor end 22 helps ensure that the zero degree 96 mark remains visible during rotation of the compass 10. A plurality of indentations 98 are located on the anchor end 22, and each indentation 98 corresponds to a rotational indicia 90 to aid in ascertaining the angle.

Having described the invention in detail and by reference to the preferred embodiments, it will be apparent that modifications and variations thereof are possible without departing from the scope of the invention.

What is claimed is:

1. A drawing compass comprising:

a body having a pivot point and a longitudinal slot formed therein, said longitudinal slot defining a first inner surface;

a carriage received in and movable along said longitudinal slot, said carriage including a guide to receive a writing instrument therethrough, said carriage including a movable arm located to engage said first inner surface said arm including a gripping surface for being manually gripped to move said arm out of engagement with said first inner surface; and means for releasably coupling said arm to said body.

2. The compass of claim 1 wherein said coupling means includes a grooved surface on said first inner surface and a grooved surface on said arm for engaging said grooved surface on said first inner surface.

3. The compass of claim 2 wherein said arm includes a head on a distal end thereof, and wherein said head includes said grooved surface of said arm.

4. The compass of claim 2 wherein each groove on said inner surface is spaced apart from any adjacent grooves by about 1 mm, and wherein each groove on said arm is spaced apart from any adjacent grooves by about 1 mm.

5. The compass of claim 1 wherein said coupling means includes a surface on said arm for frictionally engaging said first inner surface.

6. The compass of claim 1 wherein said arm is biased outwardly relative to said guide to engage said first inner surface, and wherein said arm is flexible such that said arm can be manually disengaged from said body to uncouple said carriage from said body.

7. The compass of claim 6 wherein said arm is resilient such that after a force that causes said arm to be disengaged from said slot is removed, said arm returns to a position wherein said arm engages said slot.

8. The compass of claim 1 wherein said carriage is movable within said slot when said carriage is uncoupled from said body.

9. The compass of claim 1 wherein said longitudinal slot defines a second inner surface, and wherein said carriage includes a second arm shaped to engage said second inner surface to releasably couple said carriage to said body.

10. The compass of claim 9 wherein said first and second arms are located adjacent each other such that said arms can be disengaged from said body by gripping said arms between a user's thumb and forefinger and moving said arms toward each other.

11. The compass of claim 1 wherein said body includes at least one longitudinally extending guide slot, and wherein said carriage includes at least one tab shaped to be received in said guide slot to couple said carriage to said body.

12. The compass of claim 1 wherein said body includes indicia to indicate the distance said guide is located from said pivot point.

13. The compass of claim 12 wherein said body includes a boss adjacent said longitudinal slot, and wherein said carriage includes an overlie portion shaped to fit over said boss, and wherein said boss and said overlie portion interact to guide said carriage when said carriage is moved in said slot.

14. The compass of claim 13 wherein said overlie portion includes a pointer to indicate the position of said guide relative said indicia.

15. The compass of claim 13 wherein said overlie portion is generally transparent.

16. The compass of claim 1 wherein said arm is formed from acrylonitrile butadiene styrene.

17. The compass of claim 1 wherein said pivot point can rotate relative said body.

18. The compass of claim 1 further comprising a generally transparent lens received in said body, and wherein said lens includes a protrusion forming said pivot point and located to engage a surface upon which said body is located, and wherein said lens can rotate relative said body.

19. The compass of claim 18 wherein said body includes an end adjacent said pivot point, and wherein said body includes rotational indicia adjacent said end to indicate the angle that said compass has been rotated.

20. The compass of claim 19 wherein said end is rounded and includes a plurality of indentations corresponding to said rotational indicia.

21. The compass of claim 1 wherein said means for releasably coupling said arm to said body selectively prevents movement of said carriage along said longitudinal slot.

22. The drawing compass of claim 1 wherein said gripping surface protrudes upwardly out of said longitudinal slot.

23. The drawing compass of claim 1 wherein said carriage is unitary.

24. A drawing compass comprising:

a body having a pivot point and a longitudinal slot formed therein, said longitudinal slot defining an inner wall having a grooved surface; and a carriage received in and movable along said longitudinal slot, said carriage including a guide to receive a writing instrument therethrough, said carriage including a pair of movable arms, each arm having a grooved surface, each arm being biased such that said grooved surface of each arm is biased against said inner wall to couple said carriage to said body, each arm being movable out of contact with said inner wall to enable said carriage to move along said longitudinal slot without said arm engaging said inner wall.

25. A drawing compass comprising:

a body having a pivot point and a longitudinal slot formed therein, said longitudinal slot defining a first inner surface;

a carriage received in and movable along said longitudinal slot, said carriage including a guide to receive a writing instrument therethrough, said carriage including a movable arm that is located to lockingly yet releasably engage said first inner surface to block said carriage from moving along said longitudinal slot when said arm engages said first inner surface, said arm including a gripping surface for being manually gripped to move said arm out of engagement with said first inner surface; and means for releasably coupling said arm to said body.

26. A method for drawing an arc comprising the steps of:

providing a drawing compass comprising a body having a pivot point and a longitudinal slot formed therein said longitudinal slot defining a first inner surface said compass further comprising a carriage received in and movable along said longitudinal slot, said carriage including a guide to receive a writing instrument therethrough, said carriage including a movable arm that is located to engage said first inner surface to releasably couple said arm to said body, said arm including a gripping surface;

placing said compass on a medium to be drawn upon;

manually gripping said gripping surface of said movable arm to disengage said arm from said first inner surface;

moving said carriage to a desired location along said longitudinal slot;

releasing said movable arm such that said arm engages said first inner surface to releasably couple said arm to said body;

passing a writing instrument through said guide such that said instrument contacts said medium, and rotating said writing instrument about said pivot point to draw an arc on said medium.

27. A drawing compass comprising:

a body having a pivot point and a longitudinal slot formed therein, said longitudinal slot defining a first inner surface and a second inner surface; and a carriage received in and movable along said longitudinal slot, said carriage including a guide to receive a writing instrument therethrough and a pair of movable arms, each arm having a surface that is shape to engage an associated one of said inner surfaces to releasably couple said carriage to said body, wherein said arms are located adjacent to each other such that said arms can be simultaneously disengaged from said inner surface by gripping said anus between a user's thumb and forefinger and moving said arms toward each other.

* * * * *

UNITED STATES PATENT AND TRADEMARK OFFICE

CERTIFICATE OF CORRECTION

PATENT NO. : 6,427,344 B1
DATED : August 5, 2002
INVENTOR(S) : Philip Forrest Smith et al.

It is certified that error appears in the above-identified patent and that said Letters Patent is hereby corrected as shown below:

Column 5,
Line 4, after the word "surface" insert -- , --.
Line 45, between the words "longitudinally extending" insert -- hypen --.

Column 6,
Line 51, after the word "therein" insert -- , --.
Line 52, after the word "surface" insert -- , --.

Column 8,
Line 2, the word "shape" should be -- shaped --.
Line 7, the word "anus" should be -- arms --.

Signed and Sealed this

Third Day of December, 2002

JAMES E. ROGAN
*Director of the United States Patent and Trademark Office*